US009505208B2

(12) United States Patent
Shmaiser et al.

(10) Patent No.: US 9,505,208 B2
(45) Date of Patent: Nov. 29, 2016

(54) DIGITAL PRINTING SYSTEM

(71) Applicant: LANDA CORPORATION LTD., Rehovot (IL)

(72) Inventors: Aharon Shmaiser, Rishon LeZion (IL); Benzion Landa, Nes Ziona (IL); Sagi Moskovich, Petach Tikva (IL); Nir Zarmi, Be'erotayim (IL); Yehuda Solomon, Rishon LeZion (IL)

(73) Assignee: LANDA CORPORATION LTD., Rehovot ( * ) Notice: Subject to any disclaimer, the term of this patent is extended or adjusted under 35 U.S.C. 154(b) by 0 days.

(21) Appl. No.: 14/917,020

(22) PCT Filed: Sep. 5, 2014

(86) PCT No.: PCT/IB2014/064277

§ 371 (c)(1),
(2) Date: Mar. 6, 2016

(87) PCT Pub. No.: WO2015/036906

PCT Pub. Date: Mar. 19, 2015

(65) Prior Publication Data

US 2016/0200097 A1 Jul. 14, 2016

(30) Foreign Application Priority Data

Sep. 11, 2013 (GB) ..... 1316203.7

(51) Int. Cl.

| | |
|---|---|
| ***B41J 2/01*** | (2006.01) |
| ***B41J 2/005*** | (2006.01) |
| ***B41J 11/00*** | (2006.01) |
| ***B41J 3/60*** | (2006.01) |

(52) U.S. Cl.

CPC ..... *B41J 2/0057* (2013.01); *B41J 2/01* (2013.01); *B41J 3/60* (2013.01); *B41J 11/0015* (2013.01); *B41J 2002/012* (2013.01)

(58) Field of Classification Search

None

See application file for complete search history.

(56) References Cited

U.S. PATENT DOCUMENTS

2005/0150408 A1 7/2005 Hesterman
2014/0104360 A1* 4/2014 Hacker ..... B41J 3/60 347/104

FOREIGN PATENT DOCUMENTS

| | | | |
|---|---|---|---|
| JP | H05 147208 | A | 6/1993 |
| WO | WO2013132356 | A1 | 9/2013 |
| WO | WO2013132418 | A2 | 9/2013 |
| WO | WO2013132419 | A1 | 9/2013 |
| WO | WO2013132424 | A1 | 9/2013 |

OTHER PUBLICATIONS

JP H05 147208 Machine Translation (by EPO and Google)—published Jun. 15, 1993—Mita Industrial Co Ltd.

* cited by examiner

*Primary Examiner* — Lisa M Solomon
(74) *Attorney, Agent, or Firm* — Marc Van Dyke; Fourth Dimension IP

(57) ABSTRACT

A printing system for printing on a substrate, comprises a movable intermediate transfer member in the form of a flexible, substantially inextensible, belt guided to follow a closed path, an image forming station for depositing droplets of a liquid ink onto an outer surface of the belt to form an ink image, a drying station for drying the ink image on the belt to leave an ink residue film on the outer surface of the belt, first and second impression stations spaced from one another in the direction of movement of the belt, each impression station comprising an impression cylinder for supporting and transporting the substrate and a pressure cylinder carrying a compressible blanket for urging the belt against the substrate supported on the impression cylinder, and a transport system for transporting the substrate from the first impression station to the second impression station. The pressure cylinder of at least the first impression station is movable between a first position in which the belt is urged towards the impression cylinder to cause the residue film on the outer surface of the belt to be transferred onto the front side of the substrate supported on the impression cylinder, and a second position in which the belt is spaced from the impression cylinder to allow the ink image on the belt to pass through the first impression station and arrive intact at the second impression station for transfer onto the reverse side of the substrate supported on the second impression cylinder.

10 Claims, 3 Drawing Sheets

DIGITAL PRINTING SYSTEM

FIELD OF THE INVENTION

The present invention relates to a digital printing system, and in particular to indirect printing systems having a belt serving as an intermediate transfer member.

BACKGROUND

Digital printing techniques have been developed that allow a printer to receive instructions directly from a computer without the need to prepare printing plates. Amongst these are color laser printers that use the xerographic process. Color laser printers using dry toners are suitable for certain applications, but they do not produce images of a photographic quality acceptable for publications, such as magazines.

A process that is better suited for short run high quality digital printing is used in the HP-Indigo printer. In this process, an electrostatic image is produced on an electrically charged image bearing cylinder by exposure to laser light. The electrostatic charge attracts oil-based inks to form a color ink image on the image bearing cylinder. The ink image is then transferred by way of a blanket cylinder onto paper or any other substrate.

Inkjet and bubble jet processes are commonly used in home and office printers. In these processes droplets of ink are sprayed onto a final substrate in an image pattern. In general, the resolution of such processes is limited due to wicking by the inks into paper substrates. The substrate is therefore generally selected or tailored to suit the specific characteristics of the particular inkjet printing arrangement being used. Fibrous substrates, such as paper, generally require specific coatings engineered to absorb the liquid ink in a controlled fashion or to prevent its penetration below the surface of the substrate. Using specially coated substrates is, however, a costly option that is unsuitable for certain printing applications, especially for commercial printing. Furthermore, the use of coated substrates creates its own problems in that the surface of the substrate remains wet and additional costly and time consuming steps are needed to dry the ink, so that it is not later smeared as the substrate is being handled, for example stacked or wound into a roll. Furthermore, excessive wetting of the substrate causes cockling and makes printing on both sides of the substrate (also termed perfecting or duplex printing) difficult, if not impossible.

Furthermore, inkjet printing directly onto porous paper, or other fibrous material, results in poor image quality because of variation of the distance between the print head and the surface of the substrate.

Using an indirect or offset printing technique overcomes many problems associated with inkjet printing directly onto the substrate. It allows the distance between the surface of the intermediate image transfer member and the inkjet print head to be maintained constant and reduces wetting of the substrate, as the ink can be dried on the intermediate image member before being applied to the substrate. Consequently, the final image quality on the substrate is less affected by the physical properties of the substrate.

The use of transfer members which receive ink droplets from an ink or bubble jet apparatus to form an ink image and transfer the image to a final substrate have been reported in the patent literature. Various ones of these systems utilize inks having aqueous carriers, non-aqueous carrier liquids or inks that have no carrier liquid at all (solid inks).

The use of aqueous based inks has a number of distinct advantages. Compared to non-aqueous based liquid inks, the carrier liquid is not toxic and there is no problem in dealing with the liquid that is evaporated as the image dries. As compared with solid inks, the amount of material that remains on the printed image can be controlled, allowing for thinner printed images and more vivid colors.

Generally, a substantial proportion or even all of the liquid is evaporated from the image on the intermediate transfer member, before the image is transferred to the final substrate in order to avoid bleeding of the image into the structure of the final substrate. Various methods are described in the literature for removing the liquid, including heating the image and a combination of coagulation of the image particles on the transfer member, followed by removal of the liquid by heating, air knife or other means.

Generally, silicone coated transfer members are preferred, since this facilitates transfer of the dried image to the final substrate. However, silicone is hydrophobic which causes the ink droplets to bead on the transfer member. This makes it more difficult to remove the water in the ink and also results in a small contact area between the droplet and the blanket that renders the ink image unstable during rapid movement.

Surfactants and salts have been used to reduce the surface tension of the droplets of ink so that they do not bead as much. While these do help to alleviate the problem partially, they do not solve it.

SUMMARY OF THE INVENTION

According to the present invention, there is provided a printing system for printing on front and reverse sides of a substrate, comprising a movable intermediate transfer member in the form of a flexible, substantially inextensible, belt guided to follow a closed path, an image forming station for depositing droplets of a liquid ink onto an outer surface of the belt to form an ink image, a drying station for drying the ink image on the belt to leave an ink residue film on the outer surface of the belt, first and second impression stations spaced from one another in the direction of movement of the belt, each impression station comprising an impression cylinder for supporting and transporting the substrate and a pressure cylinder carrying a compressible blanket for urging the belt against the substrate supported on the impression cylinder, and a transport system for transporting the substrate from the first impression station to the second impression station; wherein the pressure cylinder of at least the first impression station is movable between a first position in which the belt is urged towards the impression cylinder to cause the residue film on the outer surface of the belt to be transferred onto the front side of the substrate supported on the impression cylinder, and a second position in which the belt is spaced from the impression cylinder to allow the ink image on the belt to pass through the first impression station and arrive intact at the second impression station for transfer onto the reverse side of the substrate supported on the second impression cylinder.

The printing system of the invention allows different images to be printed consecutively on the same or opposite sides of the substrate. Different images may be printed consecutively on the same side of a substrate for increase the speed of the printing system by using different impression stations to print different color separations. Printing a second image on the same side of the substrate may also be used for the purpose of applying a varnish coating to a first image.

Embodiments of the invention permit the use of a thin belt because the required conformability of the outer surface of the belt to the substrate is predominantly achieved by the thick blanket carried by the pressure cylinders. The thin belt may display some ability to conform to the topography of the surface of the substrate to allow for the roughness of the surface of the substrate and may include layers having some very slight inherent compressibility. For example, the thickness of the compressible layer in the thin belt may be in the range of 100 to 400 μm, being typically around 125 μm, as compared to the thickness of the compressible layer in the blanket which may be in the range of 1 to 6 mm, being typically 2.5 mm.

By "substantially inextensible" it is meant that the belt has sufficient tensile strength in its lengthwise dimension (in the printing direction) to remain dimensionally stable in that direction. Though the printing system herein disclosed may comprise control systems to monitor any such change in the length of the belt, desirably its circumference varies by no more than 2% or no more than 1% or no more than 0.5% during operation of the system.

In each impression station, the compressible blanket on the pressure cylinder may be continuous, but if it does not extend around the entire circumference of the pressure cylinder then it needs to have a circumferential length at least equal to the maximum length of each image to be printed onto a substrate.

In an embodiment of the invention, the compressible blanket surrounds most but not all of the pressure cylinder to leave a gap between its ends, so that when said gap faces the impression cylinder, the pressure cylinder can disengage therefrom.

If the pressure cylinder of the first impression station is continuous, then a lifting mechanism may be provided to lower the pressure cylinder for operation in the first mode and to raise the pressure cylinder for operation in the second mode.

The mechanism may take the form of an eccentric supporting an axle of the pressure cylinder and a motor for rotating the eccentric to raise and lower the pressure cylinder.

The mechanism may alternatively take the form of a linear actuator.

As an alternative, the compressible blanket may extend over less than half of the pressure cylinder. In this case, displacement of the axle of the pressure cylinder is not necessary as operation of the pressure cylinder will automatically switch between the first and the second mode as the pressure cylinder rotates about its axis.

The separation between the impression cylinders may be a whole number multiple of the circumference of the impression cylinder divided by the number of sheets of substrate that can be transported by the impression cylinder at one time but, in some embodiments of the present invention, such a relationship need not apply.

In a printing system designed to print on a sheet substrate, the impression cylinder may have one or more sets of grippers for retaining the leading edge of each substrate sheet. As the substrate transport system has significant inertia, it normally runs at constant speed and cannot be braked or accelerated between sheets. For this reason, the ink images to be printed on the substrate sheets need to positioned along the belt at regular intervals with the spacing between them corresponding to a whole number multiple of the length of the arc between consecutive grippers or the circumference of the impression cylinder if it can only support one substrate sheet at a time. Furthermore, the ink images to be printed on the reverse side of the substrate sheets need to be interleaved with the ink images to be printed on the front side of the substrate sheets and, to maximize the use of the surface of the belt, these images should be located at least approximately midway between the ink images intended for the front side of the substrate.

For correct alignment of the front and rear ink images, it is important to ensure that when a substrate sheet arrives at the second impression station after traveling through the perfecting system, it should be in the correct position to receive an ink image that has followed a substantially straight line between the two impression stations. For this relationship to hold true, the total distance traveled by the trailing edge of the substrate at the first impression station (which becomes the leading edge at the second impression station) should be equal a whole number multiple of the distance on the belt between ink images intended to be printed on the front side of the substrate plus the offset between the images to be printed on the reverse side of the substrate and those to be printed on the front side. This distance is determined by the diameters and relative phasing of the grippers of the various cylinders of the perfecting system.

BRIEF DESCRIPTION OF THE DRAWINGS

The invention will now be described further, by way of example, with reference to the accompanying drawings, in which.

DETAILED DESCRIPTION OF ILLUSTRATED EMBODIMENTS

Though the invention can be used in any indirect printing system having similar configuration, it will be described below with reference to a process where liquid inks are deposited as droplets on the outer surface of an endless belt having repelling properties toward the inks being used. The following examples may refer in particular to the transfer of ink films obtained from the drying of liquid inks having an aqueous carrier typically comprising a coloring agent (e.g., pigments or dyes) and a polymeric resin, these inks having been jetted on a repelling hydrophobic surface of the belt, but the invention need not be limited to such particular embodiments.

Figure 1:
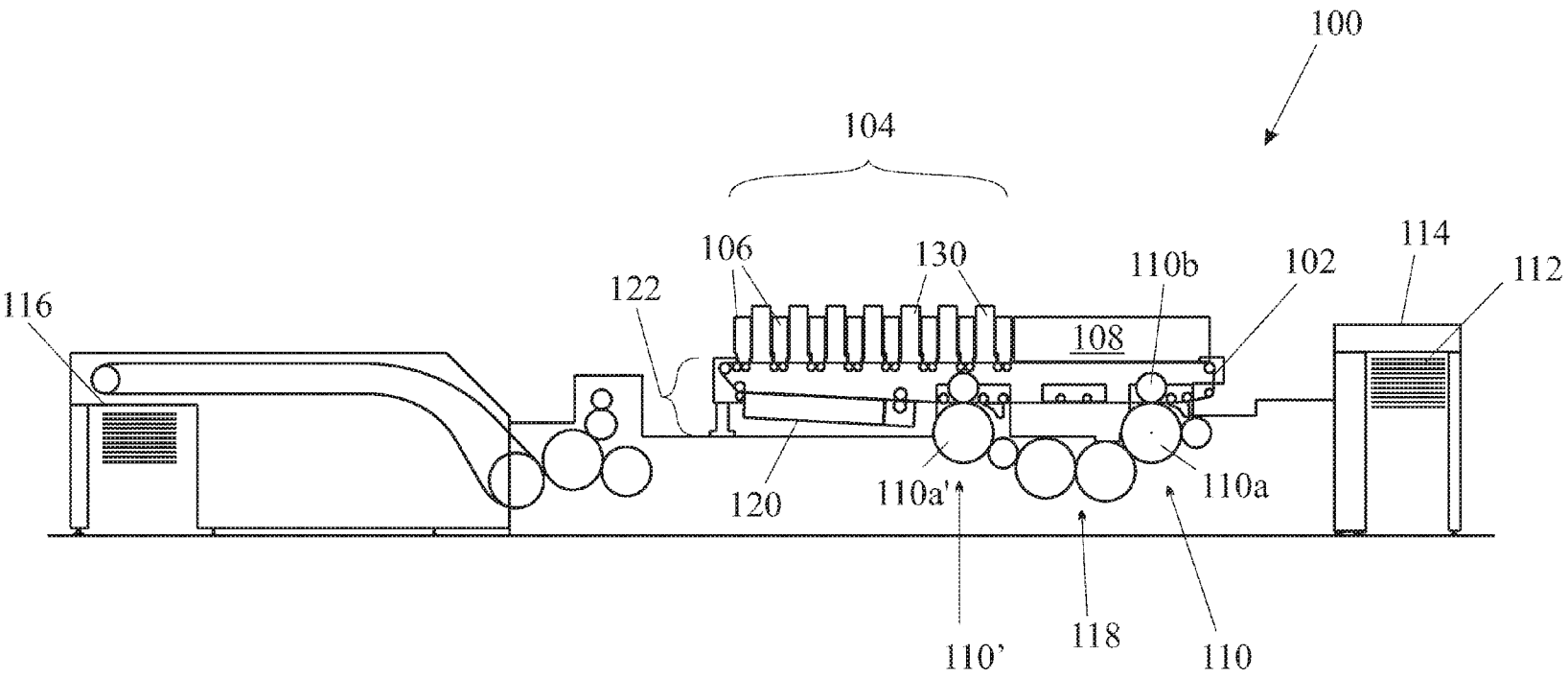
FIG. 1 is a schematic representation of a printing system.

In FIG. 1, there is shown schematically a printing system 100 having an intermediate transfer member 102 in the form of a belt having a hydrophobic outer surface guided over various rollers of a belt conveyor system 122 to travel in an endless loop. While circulating through the loop, the belt 102 passes through various stations.

At an image forming station 104, print bars 106 deposit droplets of inks onto the hydrophobic outer surface of the belt 102 to form an ink image. The inks of the different bars 106 are usually of different colors and all the inks have particles of resin and coloring agent in an aqueous carrier, apart from some transparent inks or varnishes which may not contain a pigment.

Though the image forming station illustrated in FIG. 1 comprises eight print bars 106, an image forming station may comprise fewer or more print bars. For instance, an image forming system may have three print bars each jetting Cyan (C), Magenta (M) or Yellow (Y) inks, or four print bars with the addition of a Black ink (K).

Within the image forming station 104, a gas (e.g., air) is blown onto the surface of the belt 102 in between print bars 106 by means of head units 130. This is to stabilize the ink droplets to help in fixing them to the belt 102 and to prevent bleeding.

The belt 102 then passes through a drying station 108 where the ink droplets are dried and rendered tacky before they reach impression stations 110, 110' where the ink droplets are transferred onto sheets 112 of substrate. Each impression station 110 includes an impression cylinder 110*a*, 110*a*' and a pressure cylinder 110*b*, 110*b*' which have between them a nip within which the belt 102 is pressed against a substrate. In the illustrated embodiment, the substrate is formed as sheets 112 that are transferred from an input stack 114 to an output stack 116 by a substrate transport system 118. The substrate transport system 118 comprises a perfecting system to allow double-sided, or duplex, printing, which will be described below in more detail. Two impression stations 110, 110' are provided to enable printing on both sides of the substrate, or twice onto the same side, one impression station being positioned upstream and the other downstream of the transport system 118.

It should be mentioned, that by way of example there are only two impression stations in the teachings herein however, anyone skilled in the field of digital printing may appreciate that the invention may comprise two or more impression stations. For example, a printing system with four impression stations may be utilized in order to facilitate a higher rate of printing. The use of more than two impression stations may facilitate printing of specialized inks in addition to the traditional pigment-based inks.

It should be mentioned that the invention is equally applicable to printing systems designed to print on a substrate in the form of a continuous web instead of individual sheets. In such cases, the substrate transport system is accordingly adapted to convey the substrate from an input roller to a delivery roller.

After passing through the impression stations 110, 110' the belt 102 in FIG. 1 passes through an optional cleaning and/or conditioning station 120 before returning to the image forming station 104. The purpose of the station 120 is to remove any ink that may still be adhering to the belt 102 and/or to apply a conditioning agent, to assist in fixing the ink droplets to the outer surface of the belt 102. For belts having certain silicone based outer surfaces, the conditioning agent may be polyethylenimine (PEI). The outer surface of the belt 102 is made hydrophobic to assist in a clean transfer of the tacky ink image to the substrate at the impression station(s) 110. The conditioning station 120 may also act to cool the belt 102 before it returns to the image forming station 104.

The belt 102 in some embodiments of the invention is a thin belt having an inextensible base layer with a hydrophobic release layer on its outer surface. The base layer may suitably comprise a woven fabric that is stretched and laterally tensioned and guided by means of formations on its lateral edges which engage in guide channels. The lateral tension applied by the guide channels in which the side formations of the belt may engage need only be sufficient to maintain the belt 102 flat as it passes beneath the print bars 106 of the image forming station 104. The thin belt 102 may further comprise a conformational layer with a thickness of 100 to 400 microns, but the ability to conform to the topography of the surface of a substrate may alternatively or additionally be provided by the composition of the release layer itself. The pressure cylinder 110*b*, 110*b*' in each of the impression stations 110, 110' carries a thick compressible blanket (not shown) that may typically have a thickness between 1 and 6 mm, typically 2.5 mm, that may be mounted on the cylinder in the same manner as the blanket of an offset litho press or may be a continuous blanket wrapped around or bonded to the entire circumference of the cylinder. The purpose of the blanket on the pressure cylinder is to provide the required overall conformability of the belt to the substrate, serving as a backing cushion to the belt at the impression station. Each of the thin belt and of the compressible blanket may be formed of several layers to modify any other desired capability, such as the mechanical, frictional, thermal and electrical properties of such multi-layered structures.

A printer has previously been demonstrated that had a thick belt, combining the belt 102 with a blanket but this construction requires the blanket to be replaced whenever the belt is worn despite the fact that the blanket has a greater working life. Separating the blanket from the belt and placing it on the pressure cylinder 110*b* allows the belt 102 to be replaced less expensively.

Another important advantage offered by providing a the thin belt 102 that is separate from the compressible blanket is that the mass of the circulating belt is decreased. The reduction in mass reduces the amount of power needed to drive the belt 102 thereby improving the energy efficiency of the printing system. The thin belt being devoid of a compressible layer and substantially lacking compressibility is therefore also referred to as a light belt.

The use of a light belt 102 also results in the intermediate transfer member having a lower thermal inertia, which term represents the product of its mass and its specific heat. As it travels through the various stations, the belt 102 is heated and cooled. In particular, the belt 102 is heated as its travels through the heaters of the drying station 108 and through two further optional heaters 210 positioned immediately preceding the impression stations 110 to render the ink film tacky. The temperature of the belt cannot however be high on entering the image forming station 104 because it could cause the ink droplets to boil on impact. Thus, a function of the treatment station 120 can be to cool the belt 102 before it reaches the image forming station 104. The reduction in its thermal inertia considerably reduces the energy consumption of the printing system as less heat energy is stored in the belt 102 when the ink images are being heated and therefore less energy needs to be removed, and wasted, by the treatment station 120.

Figure 2:
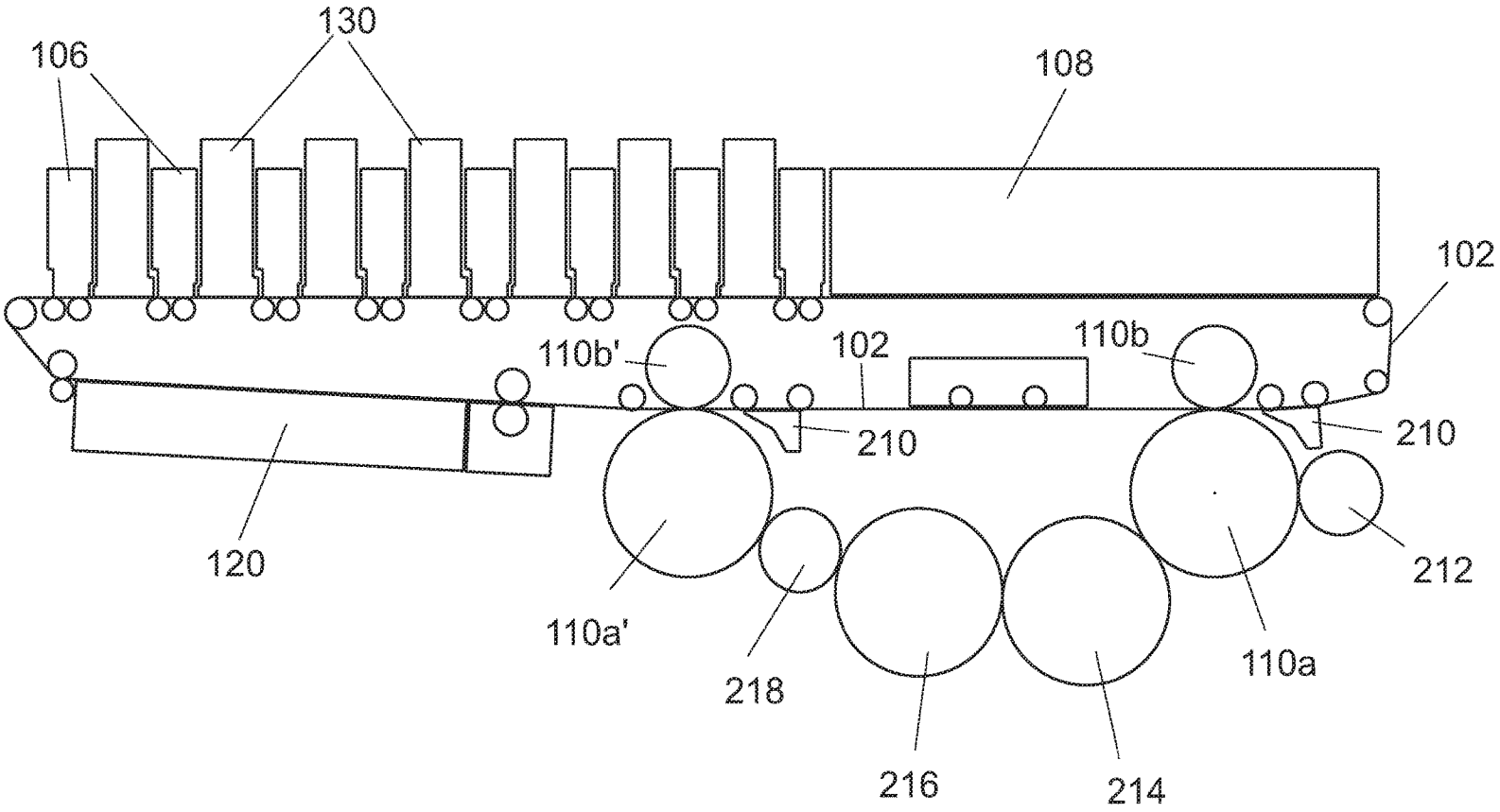
FIG. 2 is a view to an enlarged scale of part of the printing system of FIG. 1.

The substrate transport system in FIG. 2 comprises a feed cylinder 212 that feeds substrate sheets 112 from the stack 114 (not shown, but previously illustrated in FIG. 1) to the impression cylinder 110*a* of the first impression station, at which an image is printed on the front side of each sheet 112. Two transport cylinders 214 and 216 have grippers that hold each sheet by its leading edge and advance each sheet in the manner shown in FIGS. 3 and 4 past a perfecting cylinder 218. When the leading edge of a sheet 112 on the transport cylinder 216 reaches the position shown in FIG. 3, its trailing edge separates from the transport cylinder 216 and is caught by grippers on the perfecting cylinder 218. What was until this point the leading edge of the sheet 112 is then released by the grippers on the transport cylinder 216 and the sheet is offered, reverse side up, to the grippers of the impression cylinder 110*a*' of the second impression station. As well as turning each substrate sheet over, the perfecting cylinder 218 also inverts the page orientation and this must be taken into account in the manner in which the ink images are formed on the belt 102. Though the afore mentioned cylinders may each have more than one sets of grippers that could hold more than one sheet of substrate on their respective circumference, for clarity a single set of grippers is schematically illustrated as 314 and 314' in impression cylinders 110*a* and 110*a'*.

In order for the grippers at the downstream impression station to coincide with the trailing edge of the perfected substrate, the relative phase of the two impression cylinders can be adjusted as a function of the length of the substrate.

In order for an ink image to arrive at the second impression station 110', it must be capable of passing intact through the first impression station 110. For this reason, at least the first impression station 110 must switch between two modes of operation. In the first, the belt 102 is pressed against the substrate and image transfer takes place and in the second mode a gap remains between belt and the first impression cylinder so that the ink image intended for the second impression station may pass unscathed.

In some embodiments, switching between operating modes is effected by raising the axle of the pressure cylinder 110*b*. This may be carried out by using two eccentrics (one at each end) to supporting the axle of the pressure cylinder and a motor for rotating the eccentrics to raise and the lower the pressure cylinder. Alternatively, the axle may be journalled in slide blocks that are moved by a linear actuator. Such an approach may be used when the compressible blanket on the pressure cylinder encompasses the whole, or the majority, of the circumference of the pressure cylinder 110*b*.

In an alternative embodiment, the pressure cylinder 110*b* is made with a larger diameter and the blanket overlies less than half of the circumference. In this case, the axis of the pressure cylinder may remain stationary as engagement between the pressure cylinder 110*b* and the impression cylinder 110*a* will only occur at times when the blanket on the pressure cylinder faces the impression cylinder and in any cycle of the pressure cylinder, the impression stage will alternate between the first and second modes of operation.

Figure 3:
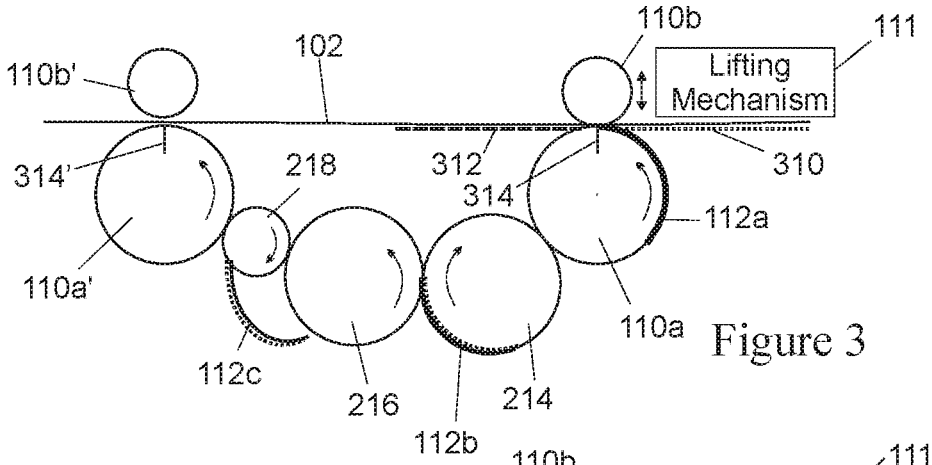
FIGS. 3 and 4 are schematic representations of the two impression stations in FIG. 2 at different times during the operating cycle.
Figure 4:
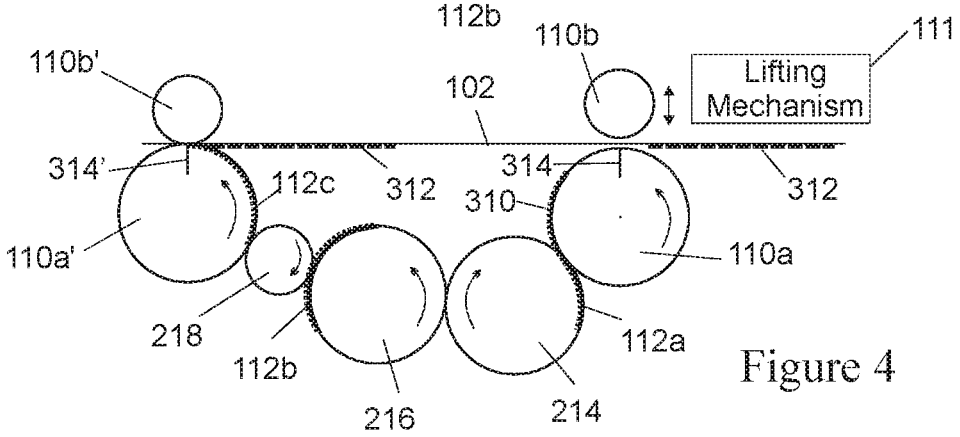

In FIGS. 3 and 4, ink images to be printed on the front side of the substrate are represented by dots and those to be printed on the reverse side a represented by dashes. FIG. 3 shows the instant at which the nip between the pressure cylinder 110*b* and the impression cylinder 110*a* of the first impression station has just been closed. A substrate sheet 112*a* on the impression cylinder is ready to receive the image 310, represented by dots, and an image 312, represented by dashes, has passed intact through the impression station while the nip was still open. At the same time, a sheet 112*b* is supported front face down on the transport cylinder 214 and a further sheet 112*c* is in the process of being transferred from the transport cylinder 216 to the perfecting cylinder 218, the sheet 112*c* being shown at the point where its trailing edge has been captured by the perfecting cylinder 218 and its leading edge released by the grippers of the transport cylinder 216.

Continued rotation of the various cylinders in the direction of the illustrated arrows results in the condition shown in FIG. 4. Here, the nip of the first impression station has been opened to allow a new image 312 to pass through. The sheet 112*a* has been transported, front side up, to the transport cylinder 214 and transferred onto the latter cylinder. The sheet 112*b* has in the meantime been transferred to the transport cylinder 216 and the sheet 112*c* that was inverted by the perfecting cylinder 218 is now supported by the second impression cylinder 110*a'* ready to pass through the closed nip of the second impression station to receive the image 312 onto its reverse side.

FIG. 3 shows the second impression station with its nip open and this avoids the surface of the belt being pressed against the impression cylinder 110*a'* when no substrate sheet is present. While this is preferable to avoid wear of the belt and possible dirtying of the impression cylinder if any ink remains on the belt, it is not essential.

The spacing between the two impression stations is not critical to correct alignment of the images on the front and reserve sides of the substrate. The length of the path of the substrate sheets through the transport system needs only to match the spacing between the front and reverse ink images on the belt 102 and this can be achieved by correct dimensioning of the diameters of the various cylinders 214, 216 and 218 and the relative phasing of their grippers.

Also illustrated in FIGS. 3 and 4 is a schematic representation of lifting mechanism 111.

While the invention has been described above by reference to printing on substrate sheets, it will be clear to the person skilled in the art that the invention is equally applicable to a printing system that prints on a continuous web. In this case, a web reversing mechanism may be used in place of the perfecting cylinder and once again the length of the web between the two impression stations needs to adjust, for example by the use of idler rollers, to correspond to the spacing of the front and reverse ink images on the belt.

In the description and claims of the present disclosure, each of the verbs "comprise", "include" and "have", and conjugates thereof, are used to indicate that the object or objects of the verb are not necessarily a complete listing of members, components, elements or parts of the subject or subjects of the verb. As used herein, the singular form "a", "an" and "the" include plural references unless the context clearly dictates otherwise. For example, the term "an impression station" may include more than one such station.

The invention claimed is:

1. A printing system for printing on a substrate, comprising:

a movable intermediate transfer member in the form of a flexible, substantially inextensible, belt guided to follow a closed path, an image forming station for depositing droplets of a liquid ink onto an outer surface of the belt to form an ink image, a drying station for drying the ink image on the belt to leave an ink residue film on the outer surface of the belt, first and second impression stations spaced from one another in the direction of movement of the belt, each impression station comprising an impression cylinder for supporting and transporting the substrate and a pressure cylinder carrying a compressible blanket for urging the belt against the substrate supported on the impression cylinder, and a transport system for transporting the substrate from the first impression station to the second impression station;

wherein the pressure cylinder of at least the first impression station is movable between a first position in which the belt is urged towards the impression cylinder to cause the residue film on the outer surface of the belt to be transferred onto the front side of the substrate supported on the impression cylinder, and a second position in which the belt is spaced from the impression cylinder to allow the ink image on the belt to pass through the first impression station and arrive intact at the second impression station for transfer onto the reverse side of the substrate supported on the second impression cylinder.

2. A printing system as claimed in claim 1, wherein, in each impression station, the blanket on the pressure cylinder is continuous and a lifting mechanism is provided to lower the pressure cylinder into the first position and to raise the pressure cylinder for into the second position.

3. A printing system as claimed in claim 1, wherein in each impression station, the blanket extends only partially around the circumference of the pressure cylinder to leave a gap between the ends of the blanket, the pressure cylinder being rotatable from the first position in which the blanket is aligned with and urged towards the impression cylinder and the second position in which the gap between the ends of the blanket is aligned with the impression cylinder.

4. A printing system as claimed in claim 3, wherein the length of the blanket is equal to or greater than the maximum size of ink images formed on the intermediate transfer member.

5. A printing system as claimed in claim 3, wherein the blanket of each impression station extends over less than half of the circumference of the pressure cylinder.

6. A printing system as claimed in claim 1, wherein the transport system includes a perfecting system for selectively inverting the substrate during transportation between the two impression stations.

7. A printing system as claimed in claim 6, for printing on substrate sheets wherein the perfecting system is formed of transport cylinders and a perfecting cylinder each having grippers to grip edges of individual substrate sheets, and wherein the dimensions of the cylinders and the phasing of the grippers are such that the length of the path followed by the trailing edges of the substrate sheets through the perfecting system is a multiple of the circumference of the impression cylinder plus the offset between the front and reverse ink images on the belt.

8. A printing system as claimed in claim 7, wherein the relative phase of the impression cylinders is adjustable to suit the length of the substrate.

9. A printing system as claimed in claim 6, wherein substrate is in the form of a web and the perfecting system is designed to transport and invert the web between impression stations.

10. A printing system as claimed in claim 1, wherein the belt is provided with formations along its lateral edges engageable in channels to guide the belt and maintain the belt in lateral tension.

* * * * *